United States Patent [19]

Hamilton et al.

[11] Patent Number: 4,759,239

[45] Date of Patent: Jul. 26, 1988

[54] WRENCH ASSEMBLY FOR A TOP DRIVE SUB

[75] Inventors: William R. Hamilton, Georgetown; Karl A. Schulz, Round Rock, both of Tex.

[73] Assignee: Hughes Tool Company, Houston, Tex.

[21] Appl. No.: 22,619

[22] Filed: Mar. 3, 1987

Related U.S. Application Data

[63] Continuation of Ser. No. 828,072, Jan. 30, 1986, abandoned, which is a continuation of Ser. No. 626,186, Jun. 29, 1984, abandoned.

[51] Int. Cl.[4] ..... B25B 13/50

[52] U.S. Cl. ..... 81/57.34; 81/57.19; 81/57.2

[58] Field of Search ..... 81/57.15, 57.16, 57.19, 81/57.2, 57.21, 57.33, 57.34, 57.39; 166/77.5, 78, 85; 175/162, 85, 113

[56] References Cited

U.S. PATENT DOCUMENTS

| | | | |
|---|---|---|---|
| 2,871,743 | 2/1959 | Kelley | 81/57.34 |
| 3,703,111 | 11/1972 | Guier | 81/57.34 |
| 3,832,918 | 9/1974 | Lang et al. | 81/57.34 X |
| 3,880,024 | 4/1975 | Asada | 81/57.34 |
| 4,023,449 | 5/1977 | Boyadjieff | 81/57.34 X |
| 4,116,015 | 9/1978 | Duncan | 81/57.2 X |
| 4,147,215 | 4/1979 | Hodge et al. | 81/57.16 X |
| 4,348,920 | 9/1982 | Boyadjieff | 81/57.16 |
| 4,421,179 | 12/1983 | Boyadjieff | 175/85 X |
| 4,449,596 | 5/1984 | Boyadjieff | 166/77.5 X |
| 4,494,425 | 1/1985 | Shewmake | 81/57.34 |

*Primary Examiner*—Debra Meislin

*Attorney, Agent, or Firm*—Charles D. Gunter, Jr.

[57] ABSTRACT

A wrench assembly for making and breaking connections between tubular members, such as a drill string and a top drive sub. The wrench assembly consists of a lower wrench and an upper wrench. The lower wrench has a curved gate arm and a curved latch arm, pivotable between an open position and a closed position. The gate arm has a plurality of teeth on its outer surface, and the latch arm has a plurality of teeth on its inner surface, for locking engagement with the teeth on the gate arm. The lower wrench also has a clamping cylinder and a die block for forcing the tubular member against the gate arm. The upper wrench, mounted above the lower wrench, has a semicircular plate. A plurality of splines are mounted on the interior surface of the semicircular plate for engagement with splines on the top drive sub. A fluid cylinder is provided for applying torque to the wrenches to rotate one of the wrenches with respect to the other wrenches.

1 Claim, 3 Drawing Sheets

WRENCH ASSEMBLY FOR A TOP DRIVE SUB

This application is a continuation of application Ser. No. 828,072, filed Jan. 30, 1986, now abandoned, which is a continuation of application Ser. No. 626,186, filed June 29, 1984, now abandoned.

BACKGROUND OF THE INVENTION

1. Field of the Invention

This invention relates in general to wrench assemblies and in particular to a wrench assembly for use with a top drive well drilling apparatus.

2. Description of the Prior Art

In the drilling of oil and gas wells, hydraulically powered wrenches are used to make and break connections between tubular members. The wrench assemblies generally used in these applications have a pair of wrenches, one mounted directly above the other. Each wrench grips a joint on either side of the connection, and torque is applied to rotate the wrenches with respect to one another, to make up or break the connection. One such wrench assembly is shown in U.S. Pat. No. 4,348,920 (BOYADJIEFF), issued Sept. 14, 1982. One disadvantage inherent in the prior art has been that the wrenches must be adjusted to accommodate tubular members of different diameters.

A top drive drilling system rotates a drill string from the top, rather than using a rotary table, a kelly, and a kelly bushing. An electric drilling motor is suspended from the drilling rig's conventional swivel and is attached to the top of the drill string. The drilling motor may also be attached to a carriage, which is guided by a pair of vertical tracks. The drilling motor is connected to the drill string by a cylindrical stem, which extends downward from the motor. A top drive sub is the bottom unit of the cylindrical stem, and is the unit to which the drill string is threaded. A wrench assembly is also suspended from the drilling motor, in order to make or break connections between the top drive sub and the drill string. In some prior art top drive drilling systems, the wrench assembly rotates with the drill string and is not removable therefrom. However, there are some top drive well drilling apparatus in which the wrench assembly may be retracted away from the drill string.

SUMMARY OF THE INVENTION

The present invention is a wrench assembly which may be used, without adjustment, on tubular members having a wide range of diameters. The wrench assembly has a lower wrench, which has a curved gate arm and a curved latch arm, which are pivotally connected to the frame of the wrench. The gate arm has a plurality of teeth on its outer surface, and the latch arm has a plurality of teeth on its inner surface. When the gate arm and the latch arm have been closed against the tubular member, the teeth on the gate arm will engage certain teeth on the latch arm, depending upon the diameter of the tubular member being gripped.

The upper wrench of the wrench assembly has a semicircular plate having a plurality of vertical splines. The splines, which are beveled on the upper end, are adapted to engage splines on the top drive sub in a top drive drilling system. When constructed according to the invention, the wrench assembly is capable of connecting and disconnecting connections between a top drive sub and a tool joint on a drill string regardless of the diameter of the tool joint.

The above, as well as additional objects, features, and advantages of the invention, will become apparent in the following detailed description.

DESCRIPTION OF THE PREFERRED EMBODIMENT

Figure 1:
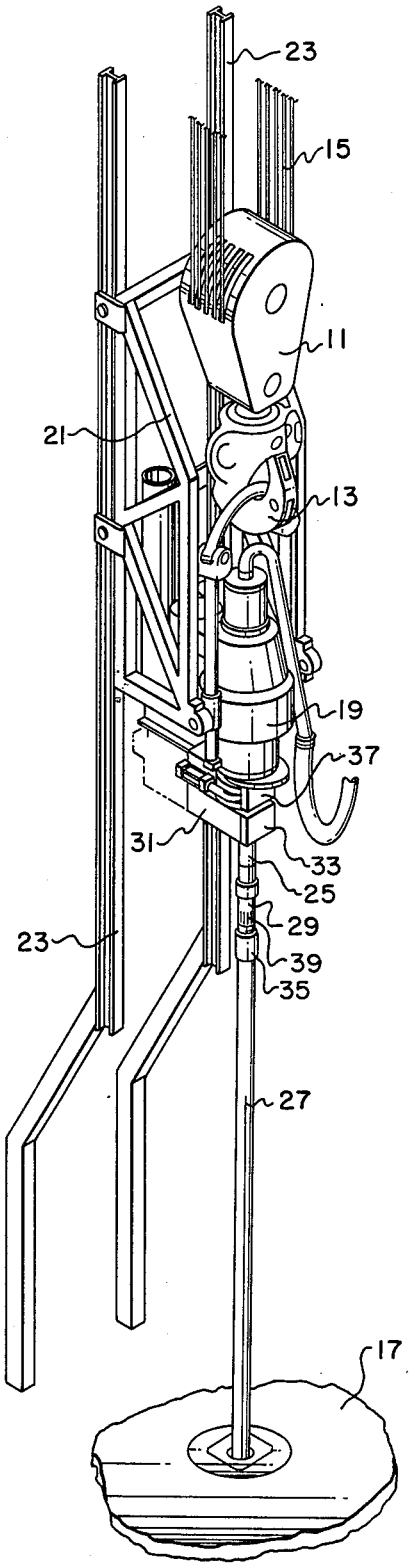
FIG. 1 is a perspective view of a top drive drilling apparatus.

FIG. 1 illustrates a top drive well drilling apparatus. A conventional traveling block 11 and a conventional hook 13 are suspended by cables 15 above the floor 17 of an oil well drilling rig. A top drive unit 19, which is a drilling motor of a conventional type, is suspended from the hook 13. A carriage 21 guides the top drive unit 19 up and down along a pair of vertical guide tracks 23. A tubular member, or stem 25, extends downward from the top drive unit 19. The upper end of a drill string 27 is threaded to a top drive sub 29, which is the lowest unit of the stem 25. The drill string 27 consists of a series of tubular members, called pipe sections, and has a rotary rock bit attached at the lower end for drilling a well bore.

A wrench assembly 31 is used to make and break connections in the stem 25 and the connection between the top drive sub 29 and the drill string 27. The wrench assembly 31 is mounted on the carriage 21, and is movable horizontally between a working position along the stem 25, or the drill string 27, and a retracted position away from the axis of the drill string 27. The wrench assembly 31 is also movable vertically along the stem 25 and the drill string 27. When the wrench assembly 31 is used to make or break the connection between the drill string 27 and the top drive sub 29, the lower wrench 33 grips the tool joint 35 on the upper end of the drill string 27, and the upper wrench 37 engages the top drive sub 29. The top drive sub 29 has a plurality of splines 39 to facilitate the engagement between the wrench 37 and the sub 29.

Figure 2:
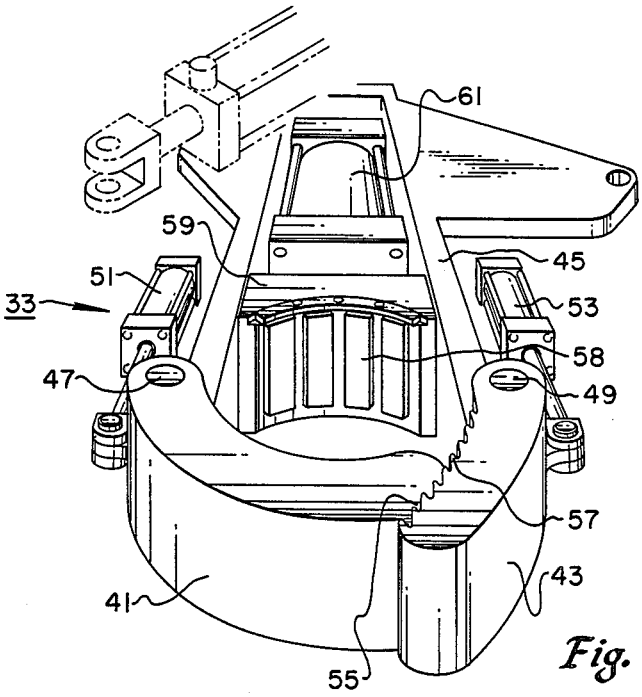
FIG. 2 is a perspective view of the lower wrench of the invention.

FIG. 2 shows the lower wrench 33 in the closed position. The lower wrench 33 has a curved gate arm 41 and a curved latch arm 43, pivotally connected to a frame 45 at pivot points 47 and 49, respectively. The gate arm 41 and the latch arm 43 are pivotable between the closed position, as shown in FIG. 2, and an open position wherein the wrench can be applied to or removed from the tool joint 35. A fluid cylinder 51, 53 is connected to each arm 41, 43 to provide means for pivoting the arms between the open and closed positions. The gate arm 41 has a plurality of latching teeth 55 on its outer surface, and the latch arm 43 has a plurality of latching teeth 57 on its inner surface for locking engagement with the teeth 55 on the gate arm 41. A die block 59, have tong dies 58, is mounted on the frame 45 opposite the gate arm 41 and latch arm 43. A clamping cylinder 61 moves the die block 59 reciprocally between a retracted position away from the drill string 27 and an extended position against the drill string 27. The clamping cylinder 61 and die block 59 are a means for forcing the tool joint 35 against the gate arm 41.

Figure 3:
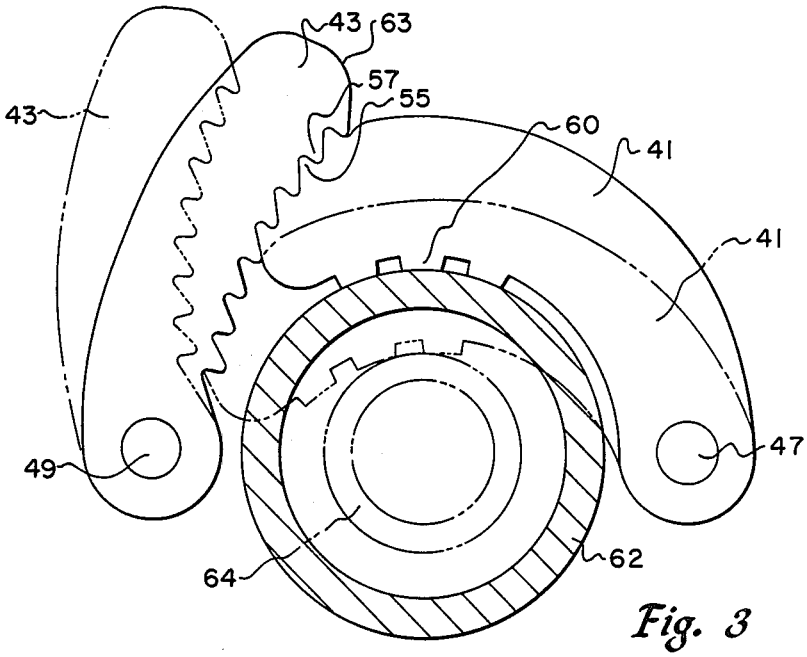
FIG. 3 is a top view, partially in section, showing how the gate arm and the latch arm engage tubular members of different diameters.

FIG. 3 illustrates how the wrench is capable of engaging tubular members of different diameters, without having to be adjusted. The solid lines show tong dies 60 on the gate arm 41 engaging a tubular member 62 of a larger diameter. The teeth 55 on the gate arm 41 engage the teeth 57 on the latch arm 43, and the specific teeth 57 which are engaged are near the outer end 63 of the latch arm 43. When the gate arm 41 engages a tubular member 64 of a smaller diameter, as shown in shadow in FIG. 3, the teeth 55 on the gate arm 41 engage a different set of teeth 57 on the latch arm 43. In this case, the engaged teeth 57 on the latch arm 43 are closer to the pivot point 49. For tubular members of various diameters, the gate arm teeth 55 will engage different latch arm teeth 57. Thus, the gate arm 41 is capable of engaging tubular members having a wide range of diameters, without having to be adjusted.

Figure 4:
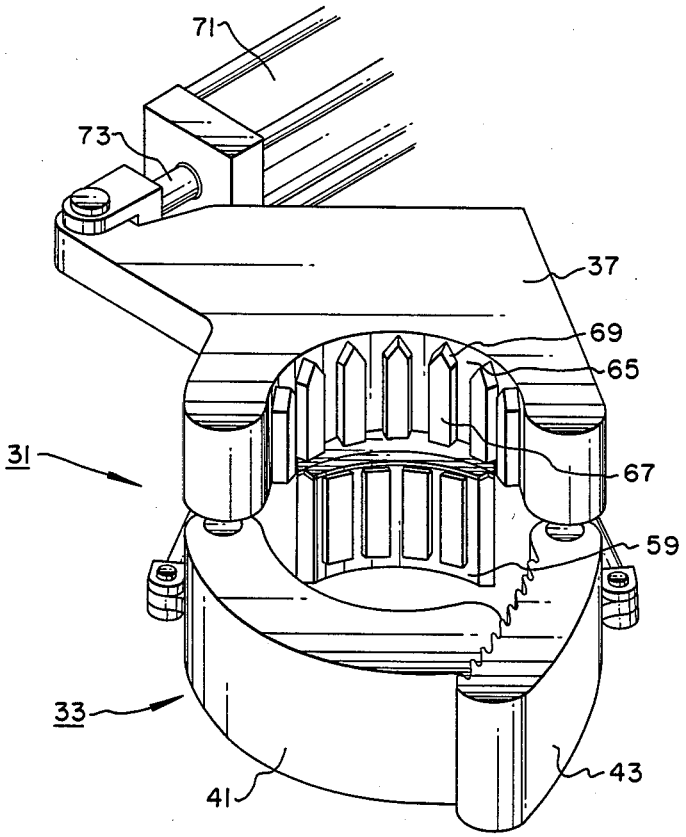
FIG. 4 is a perspective view of the wrench assembly of the invention.

FIG. 4 shows the entire wrench assembly 31, which consists of the lower wrench 33 and an upper wrench 37. The upper wrench 37 does not completely encircle the top drive sub 29 but rather has a semicircular plate 65. A plurality of vertical splines 67 are mounted on the interior surface of the semicircular plate 65, for engaging the splines 39 on the top drive sub 29. The splines 67 on the upper wrench 37 are spaced apart so as to fit between the splines 39 on the top drive sub 29. The upper end of each spline 67 is beveled to facilitate engagement with the splines 39 on the top drive sub 29. A fluid cylinder 71 is attached to the lower wrench 33, and the piston rod 73 is connected to the upper wrench 37. When the piston rod 73 is extended, the upper wrench is rotated counterclockwise, relative to the lower wrench 33. The fluid cylinder 71 and piston rod 73 are thus means for applying torque to the wrenches 33, 37 to rotate one of the wrenches with respect to the other wrench.

In operation, the wrench assembly 31 is first retracted away from the stem, and then lowered to a position below the connection between the tool joint 35 and the top drive sub 29. The wrench assembly 31 is then extended back to the center line of the drill string 27. The wrench assembly 31 is raised to engage the splines 67 on the upper wrench 37 and the splines 39 on the top drive sub 29. Interrotational capability is provided to align the splines 39, 67, aided by the bevels 69 at the top of the wrench splines 67. The splines 37 on the top drive sub 29 are beveled at the lower end.

When the upper wrench 37 is aligned with the top drive sub 29, the lower wrench 33 will be aligned with the tool joint 35 at the top of the drill string 27. The fluid cylinder 51 is actuated to pivot the gate arm 41 to its closed position, in which the inner surface of the gate arm 41 contacts the tool joint 35. Fluid cylinder 53 is then actuated to pivot the latch arm 43 to close onto the gate arm 41. The latching teeth 57 on the latch arm 43 may or may not mesh with the teeth 55 on the gate arm 41 at this point. The clamping cylinder 61 is then actuated to extend the die block 59. The die block 59 pushes the tool joint 35 against the gate arm 41. The clamping cylinder 61 exerts substantial pressure and overcomes the gate arm cylinder 51, causing the gate arm 41 to be pushed back. The gate arm 41 will continue to be pushed back until the teeth 55, 57 on the arms 41, 43 become interlocked. The pressure in the clamping cylinder 61 is increased until the desired clamping pressure is achieved. The torquing cylinder 71 is then actuated to rotate the upper wrench 37 in relation to the lower wrench 33, thus making or breaking the connection between the top drive sub 29 and the tool joint 35 on the drill string 27.

To remove the wrench assembly 31 from the connection, the lower wrench 33 is first released. To release the lower wrench 33, the clamping cylinder 61 retracts the die block 59 from the tool joint 35. Fluid cylinder 53 then pivots the latch arm 43 to the open position, and fluid cylinder 51 pivots the gate arm to the open position. The wrench assembly 31 is then lowered to disengage the splines 39, 67 on the top drive sub 29 and the top wrench 37. The wrench assembly 31 is retracted away from the connection, raised, and returned to its storage position beneath the top drive unit 19.

The wrench assembly of the invention has several advantages over the prior art. Because of the various teeth 57 on the latch arm 43 which may be engaged by the gate arm teeth 55, the wrench assembly 31 may be used on a large variety of tubular members without having to be adjusted. The spline connection between the upper wrench 37 and the top drive sub 29 eliminates the need to repeatably grip the top drive sub with tong dies. Repeated gripping with tong dies would damage the sub 29, which must then be replaced. The wrench assembly 31 of the invention can be retracted away from the stem 25 and the drill string 27. This capability allows the wrench assembly 31 to remain stationary rather than to rotate with the drill string 27. The ability of the wrench assembly 31 to be raised to the storage position, shown in FIG. 1, allows the top drive drilling apparatus to drill the drill string to a deeper depth before additional pipe sections must be added to the drill string 27.

While the invention has been shown in only one of its forms, it should be apparent to those skilled in the art that it is not so limited, but is susceptible to various changes and modifications without departing from the spirit thereof. For example, the wrench assembly may have an upper wrench of the same design as the lower wrench 33 described above.

We claim:

1. A wrench assembly for making and breaking the threaded connection between a tubular member and a top drive sub having a plurality of axially oriented splines located on the exterior thereof, the tubular member being suspended vertically in a well drilling rig from the top drive sub, the wrench assembly comprising:

a frame, the frame being located at an elevated location above the rig floor;

a one piece, curved gate arm mounted on the frame, the gate arm having an interior surface for contacting one of the tubular members and an exterior surface, the gate arm having one end pivotally secured to the frame and having an opposite end, the opposite end having a plurality of latching teeth on the exterior surface thereof;

a one piece, curved latch arm mounted on the frame, the latch arm having an interior surface and an exterior surface, the latch arm having an end pivotally secured to the frame at a position opposite the gate arm to thereby define a pipe engaging opening within the frame, the latch arm having a plurality of latching teeth along the interior surface for engagement with the latching teeth on the gate arm;

a die block mounted on the frame within the pipe engaging opening, the die block being reciprocally movable between a retracted position away from the tubular members and an extended position against the tubular members;

a fluid cylinder having a cylinder rod attached to the pivoting end of the gate arm for pivoting the gate arm between an open position and a closed position;

a second fluid cylinder having a cylinder rod attached to the pivoting end of the latch arm for pivoting the latch arm between an open position and a closed position; and a second wrench mounted on the frame above the gate arm and latch arm, the second wrench comprising a semi-circular member having an interior surface provided with a plurality of axially oriented splines for engaging the splines on the exterior of the top drive sub.

* * * * *